United States Patent [19]

Bonvicini

[11] 4,018,209

[45] Apr. 19, 1977

[54] AIR HEATER

[76] Inventor: Gene Ferruccio Bonvicini, Morehouse Road, Easton, Conn. 06612

[22] Filed: Nov. 12, 1975

[21] Appl. No.: 631,369

[52] U.S. Cl. ..... 126/121; 122/359; 165/176; 237/51

[51] Int. Cl.[2] ..... F24B 7/04

[58] Field of Search ..... 126/121, 110 R, 110 B, 126/72; 237/51; 165/176; 122/359

[56] References Cited

UNITED STATES PATENTS

| | | | |
|---|---|---|---|
| 254,398 | 2/1882 | Smith | 126/121 |
| 1,313,085 | 8/1919 | Greene | 126/121 |
| 2,215,236 | 9/1940 | Uckotter | 126/72 X |
| 3,001,521 | 9/1961 | Reilly | 126/121 |
| 3,675,710 | 7/1972 | Ristow | 165/176 X |
| 3,901,212 | 8/1975 | Stites | 126/121 |
| 3,930,490 | 1/1976 | Lassy et al. | 126/121 |
| 3,930,491 | 1/1976 | Miller | 126/121 |

*Primary Examiner*—William E. Wayner
*Assistant Examiner*—William E. Tapolcai, Jr.
*Attorney, Agent, or Firm*—Wooster, Davis & Cifelli

[57] ABSTRACT

An air heater comprising a pipe assembly having an intake opening and an outlet opening which is horizontally supported by a stand and protected by a removable, open-topped sleeving. The pipe assembly is a series of internally interconnected pipes which provides a continuous air flow passageway from the intake opening to the outlet opening. The pipe assembly is heated by a small fire inside the sleeving while a pump forces cold air into the intake opening. As the pumped, cold air circulates through the heated pipe assembly, the air becomes heated, and hot air is expelled at the outlet opening.

5 Claims, 3 Drawing Figures

AIR HEATER

BACKGROUND OF THE INVENTION

This invention relates to an improvement in a type of air heaters which provides a continuous flow of hot air by forcing unheated air to circulate through a series of interconnected, heated pipes. These heaters are frequently used in fireplaces, where the pipes are heated by a small fire and are quite useful in that they provide an economical source of hot air heat which can be used to heat rooms. These air heaters are generally not kept in the fireplace but are usually stored when not in use.

There are several types of prior art heaters. These prior art units are of one piece and are of considerable size. Further, since the pipes are made of a heavy gauge steel to withstand the heat from the fire, the prior art devices are also of considerable weight. Consequently, due to their substantial size, weight and unitary construction, the prior art heaters are difficult to transport, handle and store. In addition, their large size and pipe structure make them very unsightly.

Another more important drawback with the prior art heaters is that they are not efficient as there is a considerable amount of heat loss in the system. The prior art heaters are unprotected from cold air drafts which can cool the piping thereby cooling the air inside and reducing the ultimate temperature of the heated air expelled from the device. Furthermore, a large amount of the piping in some of the prior art devices extends away from the fire so that there is a considerable distance between these pipes and the fire. This necessarily reduces the heating effect on this piping and thereby also reduces the heating performance of the prior art heating unit. Finally, most prior art heaters are not arranged to allow the fireplace to be used for cooking when they are in operation.

Despite these drawbacks in terms of efficiency, handling and use, these types of heating units are becoming increasingly well-known and widely used because of the increasing cost of fuel oil, gas and electricity. Although they do not function as a complete subsitute for the other more expensive types of heating systems, they do supplement such systems at considerable savings since these units can operate by burning otherwise useless rubbish, such as newspapers, wrapping paper and wood chips. Therefore, in addition to providing an alternate source of heat thereby saving more precious fuels, these devices also serve to reduce the amount of waste material which must be discarded.

SUMMARY OF THE INVENTION

The heater according to the invention herein is more efficient and easier to handle and store than prior art heaters. The improved heater comprises only two basic parts which are a horizontal pipe assembly and a sleeving which removably surrounds the pipe assembly when the heater is in operation.

The pipe assembly of this invention consists of a series of heating pipes arranged parallel to each other and spaced closely together. The rear end of each of the heating pipes is connected to the inside of a rear header which is disposed perpendicularly to the heating pipes. A front header is similarly attached to the front ends of the heating pipes. The headers serve to hold the pipe assembly together and at the same time provide an air passage between the heating pipes. Both headers have baffles inside which direct the flow of air from one heating pipe to the adjacent heating pipe in the series thereby forcing the air to circulate through each heating pipe in the pipe assembly. The pipe assembly which is very compact is mounted horizontally on a short stand for actual operation.

The removable sleeving having an open top and bottom fits around the pipe assembly. When the sleeving is in place, it extends from the base of the stand for the pipe assembly to above the top of the pipe assembly itself. A fire is located inside the sleeving directly under and close to the pipe assembly, and the sleeving acts to direct the heat upward and concentrate it on the pipe assembly itself. At the same time, the sleeving shields the heating pipes from cold drafts of air which would cool them.

When the heater is in operation, a small pump forces air through the pipe assembly. As the pumped air circulates through the pipes heated by the fire, the air temperature continually increases. Finally, when the hot air is expelled from the pipe assembly, it is directed where desired by means of a flexible hose and may be used to heat various rooms of a house or bake with a hot air oven. In addition, when the heater is operating, the pipe assembly itself can be used as a grill to cook foods.

Accordingly, a principal object of this invention is to provide an air heater which is more efficient than known heaters.

Another object of the present invention is to provide a heater which can be easily handled, stored or transported.

Another object of the present invention is to provide a heater which can itself also be used for cooking while operating as a heater.

Other and more specific objects of the invention will be in part and will in part appear from the following description of the preferred embodiment and the claims taken together with the drawings.

DRAWINGS

The same reference numbers refer to the same elements throughout the various Figures.

DESCRIPTION OF THE PREFERRED EMBODIMENT

Figure 1:
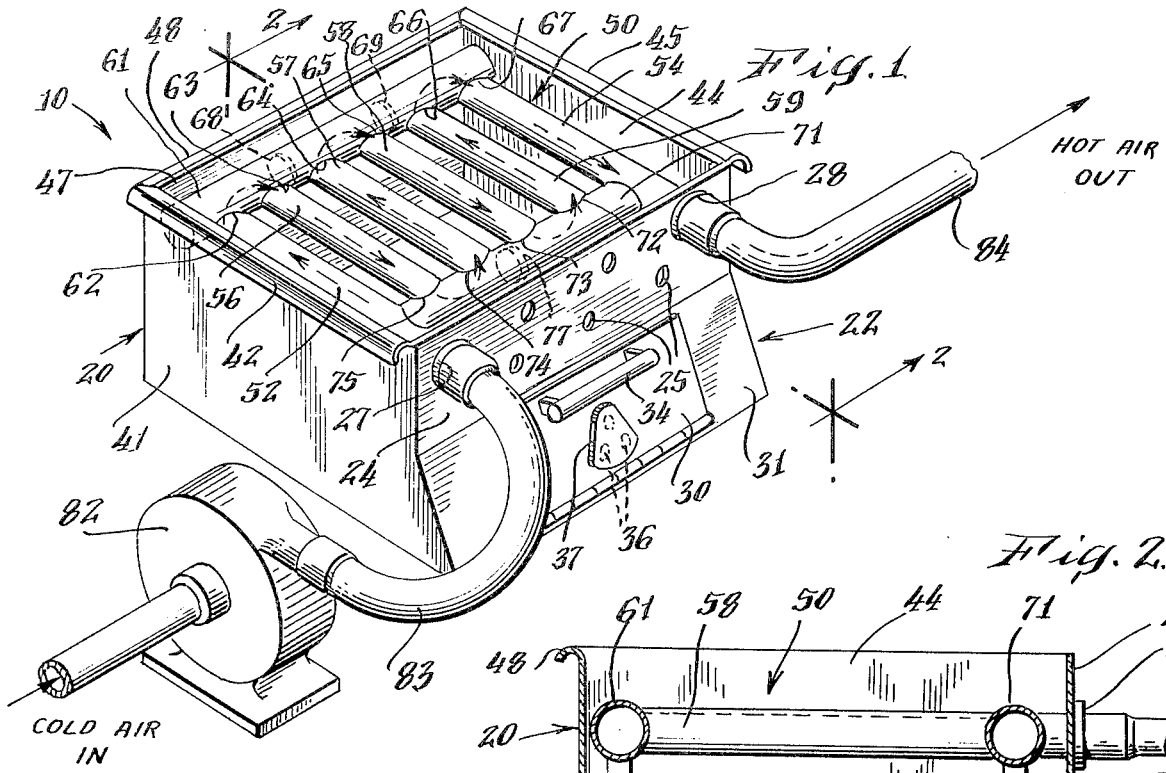
FIG. 1 is a perspective view of the heater according to the invention herein.

Referring now to FIG. 1, the heater according to the invention herein is shown at 10. The heater 10 generally comprises two main elements which are a protective sleeving 20 and a pipe assembly 50.

As shown in FIG. 1, the sleeving 20, which is made of metal, is generally box-shaped having an open top and bottom. The sleeving 20 has a front plate 22 which is comprised of two sections; an upper section 24 and a lower section 31. As shown in FIG. 1, the rectangular upper section 24 extends from the top of the sleeving 20 to the approximate midpoint of the front plate 22. The upper section 24 has a number of small, spaced apart, vent holes 25 as shown in FIG. 1. A large intake pipe hole 27 is located near one side of the upper section 24 of the front plate 22, and an outlet pipe hole 28 is located near the opposite side of the upper section 24. Both the intake pipe hole 27 and the outlet pipe hole 28, which are of the same size, are equidistant from the top of the front plate 22, and the centers of both are longitudinally aligned on the front plate 22.

Figure 2:
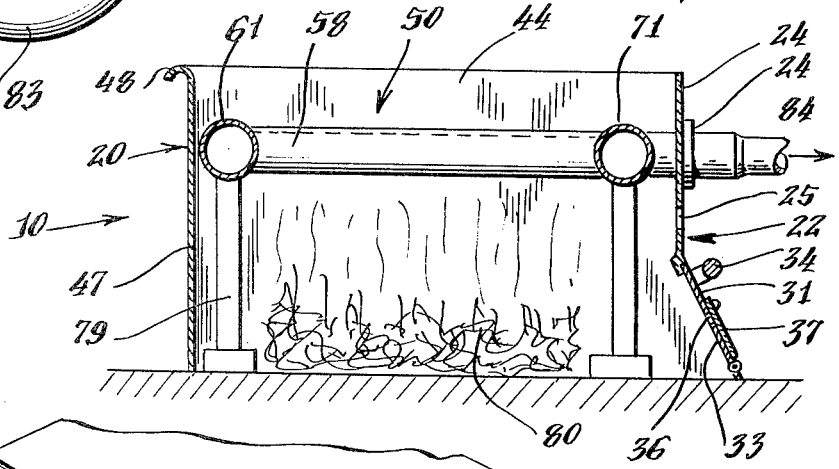
FIG. 2 is an enlarged cross-sectional view taken along lines 2—2 of FIG. 1.

The rectangular lower section 31 of the front plate 22 outwardly extends from the bottom of the upper section 24 to the bottom of the sleeving 20, as shown in FIGS. 1 and 2. The lower section 31 has a centrally disposed, hinged door 33. The door 33 has a handle 34 disposed near its top. As shown in FIG. 1, the door 33 also has some door vent holes 36, and a movable lid 37. The movable lid 37 may be selectively positioned to cover or to expose the door vent holes 36.

One end of a first sidewall 41 is perpendicularly attached to the vertical edge of the front plate 22 nearest the intake pipe hole 27 and extends rearwardly from the front plate 22. The first sidewall 41 is of the same height as the front plate 22. It is positioned with relation to the front plate 22 so that the top edge and bottom edge of both are aligned, and the top edge of the first sidewall 41 is perpendicular to the vertical edge of the upper section 24 of the front plate 22. The first sidewall 41 has an outwardly projecting lip 42 along its top edge which facilitates handling of the sleeving 20.

A second sidewall 44 which is identical in size and shape to the first sidewall 41 is similarly attached to the opposite vertical edge of the front plate 22 nearest the outlet pipe hole 28. The second sidewall 44 also has an outwardly projecting lip 45 along its top edge.

A rear plate 47, having the same height as the sidewalls 41, 44, and the same length as the front plate 22 is disposed between the ends of the sidewalls 41, 44 opposite the front plate 22. The rear plate is positioned parallel to the front plate 22, and its top and bottom edges are aligned with the top and bottom edges of the sidewalls 41, 44. The rear plate 47 also has an outwardly projecting lip 48 along its top edge.

In the preferred embodiment of this invention, the pipe assembly 50 is comprised of a series of parallel, closely spaced heating pipes interconnected and held together by a rear header 61 and a front header 71.

The rear header 61, which is stoppered at both ends, has a series of six, closely spaced, rear header holes 62 – 67 all of which are of the same size and longitudinally aligned along the side of the rear header 61. One end of an intake pipe 52 is concentrically aligned with the first of the rear header holes 62 and perpendicularly connected to the rear header 61. An outlet pipe 54 is similarly connected to the rear header 61 opposite the intake pipe 52 at the last of the rear header holes 67, as shown in FIG. 1. Each of a series of four identical inner heating pipes 56 – 59 is similarly attached to one of the interior rear holes 63 – 66. The intake pipe 52 and the outlet pipe 54 are of the same length and are slightly longer than the inner heating pipes 56 – 59. The intake pipe 52, the outlet pipe 54, and the inner heating pipes 56 – 59 are closely spaced and parallel to each other. They are all open ended and internally unobstructed, and all have approximately the same diameter which is the same or slightly greater than that of the rear header holes 62 – 67.

The front header 71 has a series of four, closely spaced front header holes 72 – 75 which correspond to the interior rear header holes 63 – 66. The front header holes 72 – 75 are similarly longitudinally aligned on the side of the front header 71.

Each of the ends of the inner heating pipes 56 – 59 opposite the rear header 61 is concentrically aligned with one of the front header holes 72 – 75 and perpendicularly attached to the front header 71. All the connections between the pipes and the headers are made as airtight as possible.

As shown in FIG. 1, the front header 71 is also connected perpendicularly between the side of the intake pipe 52 and the side of the outlet pipe 54 near their ends opposite the rear header 61. The front header 71, however, is not internally connected to either the intake pipe 52 or the outlet pipe 54.

As shown in FIG. 1, a first rear baffle 68 is disposed inside the rear header 61 between the second rear header hole 63 and the third rear header hole 64. A second rear baffle 69 is disposed inside the rear header 61 between the fourth rear header hole 65 and the fifth rear header hole 66. Similarly, a front baffle 77 is centrally disposed in the front header 71 between the second front header hole 73 and the third front header hole 74. All the baffles 68, 69, 77 for an airtight seal with the headers.

As shown in FIG. 2, the pipe assembly 50 is horizontally disposed and supported by a stand 79 when in operation. When the sleeving 20 is attached, it surrounds the pipe assembly 50 and its stand 79, and the ends of the intake pipe 52 and the outlet pipe 54 opposite the rear header 61 extend through the intake pipe hole 27 and the outlet pipe hole 28, respectively, as best shown in FIG. 1.

When the heater 10 is assembled and in operation, a fire 80 as shown in FIG. 2 is positioned under and close to the pipe assembly 50 thereby heating the pipe assembly 50. The fire 80 is surrounded by the sleeving 20 and access to the fire is provided by the sleeving door 33. Air reaches the fire 80 through the vent holes 25 and 36, but cold drafts of air which would cool the pipe assembly 50 and the fire 80 are kept away by the sleeving 20.

As shown in FIG. 1, a pump 82 forces air through a flexible intake hose 83 which is connected to that portion of the intake pipe 52 extending outside the sleeving 20. The air is forced through the intake pipe 52 and into the rear header 61 where the first baffle 68 directs the air flow into the inner heating pipe 56 adjacent to the intake pipe 52. This process of directing the air flow through one pipe, into the header and then into the adjacent pipe continues until the air circulates through the entire pipe assembly 50 and reaches the end of the outlet pipe 54 extending outside the sleeving 20. As the pipe assembly 50 is being heated by the fire 80, the air becomes heated as it circulates through the pipe assembly 50. A flexible outlet hose 84 is connected to the front portion of the outlet pipe 54 and the heated air can be directed as desired. At the same time, the top of the pipe assembly 50 can function as a grill for cooking food.

Figure 3:
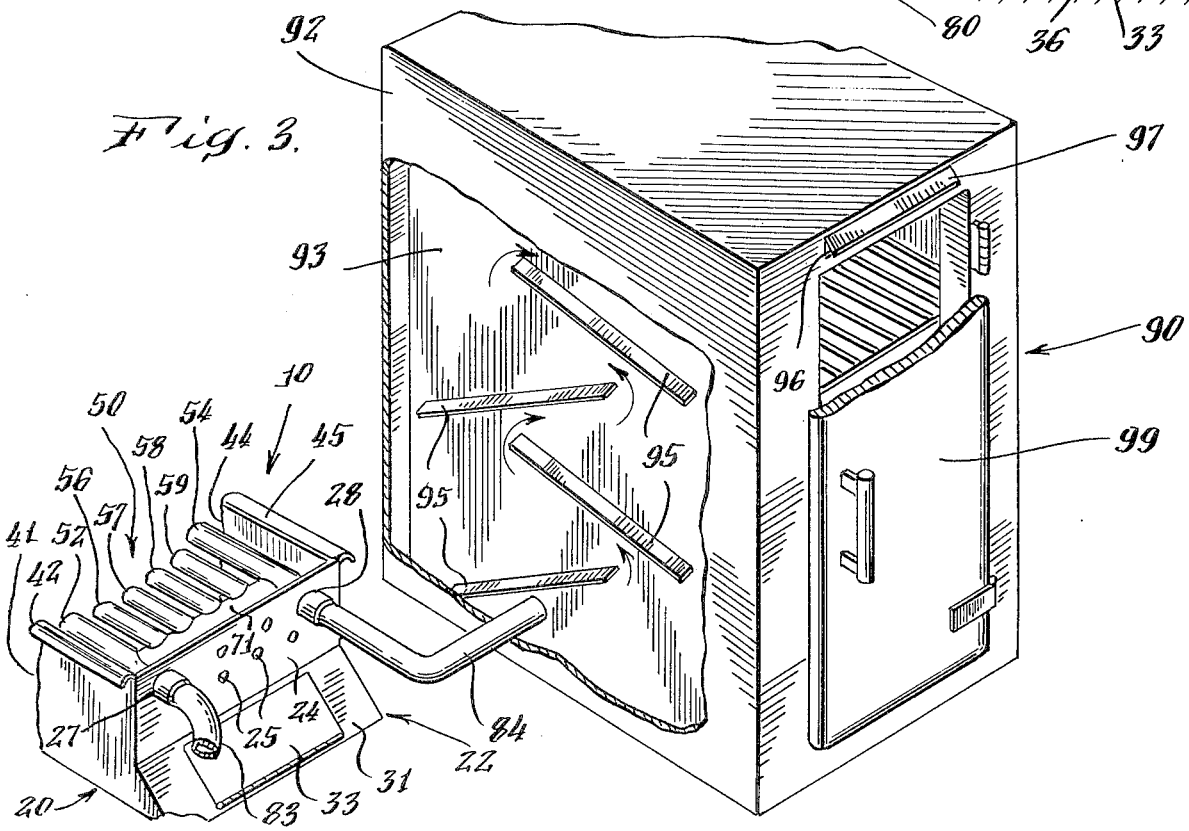
FIG. 3 is a reduced perspective view of a portion of the heater connected to a hot air oven which is shown with a portion of its outer wall cut away.

As shown in FIG. 3, an oven 90 may be connected to the flexible outlet hose 84. The oven 90 is comprised of an insulated outer wall 92 and an inner wall 93. Except at the bottom of the oven 90, the insulated outer wall 92 and the inner wall 93 are spaced apart. The heated air from the flexible outlet hose 84 is fed between the insulated outer wall 92 and the inner wall 93 at the base of the oven 90. A series of oven air flow baffles 95 which are located on the inner oven wall 93 cause the heated air to circulate as it rises to the top of the oven 90. The oven 90 is provided with an oven vent 96 near its top which allows the heated air to escape. The oven vent 96 has an oven vent cover 97 which can be adjusted so as to permit as little or as much heated air to escape thereby controlling the temperature of the oven 90. The oven 90 has a door 99 which provides access to the interior of the oven 90.

The heater can be modified in several ways without departing from the spirit of the invention. A T joint or similar valve can be added to the outlet pipe and the heated air can therefore be directed to several different places at the same time. Also, it would be possible to add additional pipes to the series in the pipe assembly or to arrange the pipes differently. For example, instead of the single row of pipes of the preferred embodiment, a double row may be used. It is also possible to configure the oven differently, and satisfactory results are obtained by arranging the oven so as to operate on its side rather than standing upright.

It is also possible to construct the sleeving without a back plate. Such a three-sided sleeving has the advantage of being very easy to remove from around the pipe assembly, while at the same time still being effective to shield the pipe assembly from cold air as the open rear portion would be placed close to the rear wall of the fireplace. To give the three-sided sleeving rigidity, a narrow crossbar may be used to connect the top of the sidewalls at the rear.

From the foregoing description of the invention and the discussion of the prior art heaters, the numerous advantages and improvements incident in this invention will now be apparent to those skilled in the art.

Accordingly, the above description of the invention is to be construed as illustrative only rather than limiting. The invention is limited only by the scope of the following claims.

I claim:

1. An air heater comprising a pipe assembly, said pipe assembly having an intake pipe defining an intake opening at one end, and an outlet pipe defining an outlet opening at one end, said pipe assembly providing a continuous air passageway between said intake opening and said outlet opening, means for horizontally supporting said pipe assembly, a protective sleeving removably attached to said pipe assembly, said sleeving having an open top and bottom and at least partially, vertically surrounding said pipe assembly when in place, said sleeving having a front plate, a rear plate and a pair of side panels, the upper portion of said front plate defining an intake pipe hole and an outlet pipe hole through which the front portion of said intake pipe and said outlet pipe outwardly protrude when said heater is assembled, said front plate having a plurality of vent holes and a centrally disposed door in its lower portion, said sleeving also having an outwardly projecting lip extending around a portion of its top edge, a means for heating said pipe assembly and a means for continuously forcing air into said intake opening and through said pipe assembly.

2. An air heater as defined in claim 1 wherein said sleeving extends from above said pipe assembly to the bottom of said stand when said heater is assembled.

3. An air heater as defined in claim 2 wherein said means for continuously forcing air into said intake opening is comprised of an electric air pump removably attached to said intake opening of said pipe assembly by a flexible hose.

4. An air heater as defined in claim 3 wherein said means for heating said pipe assembly comprises a fire built directly under said pipe assembly inside said sleeving.

5. An air heater as defined in claim 4 wherein an outlet hose is connected to said outlet opening, the end of said outlet hose opposite said outlet opening being connected to a hot air oven, said oven having an insulated outer wall spaced apart from an inner wall having a plurality of oven air flow baffles disposed thereon, said outlet hose being connected to said oven in such a manner as to direct the hot air flow between said inner wall and said outer wall of said oven, said oven having an exhaust vent to allow the hot air to escape from said oven after the hot air has circulated between said inner wall and said outer wall.

* * * * *